United States Patent [19]

Miki et al.

[11] 4,344,477

[45] Aug. 17, 1982

[54] METHOD OF DIE CASTING A METALLIC CAST PRODUCT HAVING A METALLIC HOLLOW MEMBER EMBEDDED THEREIN

[75] Inventors: Isao Miki, Shimizu; Takeshi Kishihara, Fuji; Toshiyuki Kawai, Shimizu; Naoyuki Furumaki, Shizuoka, all of Japan

[73] Assignee: Nippon Light Metal Co., Ltd., Tokyo, Japan

[21] Appl. No.: 138,895

[22] Filed: Apr. 10, 1980

[30] Foreign Application Priority Data

Apr. 16, 1979 [JP] Japan ..... 54-45468

[51] Int. Cl.[3] ..... B22D 19/12

[52] U.S. Cl. ..... 164/98; 164/112

[58] Field of Search ..... 164/98, 108, 111, 112

[56] References Cited

U.S. PATENT DOCUMENTS 1,975,889 10/1934 Whiteley ..... 164/112 X 3,709,280 1/1973 MacMillan ..... 164/112

FOREIGN PATENT DOCUMENTS 465 of 1864 United Kingdom ..... 164/112

879287 10/1961 United Kingdom ..... 164/112

*Primary Examiner*—Robert D. Baldwin

*Assistant Examiner*—J. Reed Batten, Jr.

*Attorney, Agent, or Firm*—Oblon, Fisher, Spivak, McClelland & Maier

[57] ABSTRACT

The method of die casting a metallic cast product having a hollow metallic member embedded therein by locating the hollow member in position in a casting cavity and injecting molten metal into the cavity around the hollow member including confining a pressure resisting medium within the interior of the hollow member by seals prior to injecting the molten metal into the cavity, thereby positively preventing the hollow member from being collapsed by the pressure of the molten metal injected into the cavity. The pressure resisting medium is sealingly confined within the hollow member by tightly applying a sealing plug to the respective open ends of the hollow member after the pressure resisting medium completely fills the hollow member. One of the sealing plugs may be movable in response to the increase in the internal pressure of the pressure resisting medium. The movable plug is located in cooperation with a plunger actuated by a fluid actuated cylinder mechanism so as to apply to the movable plug a constant resisting force resisting against the internal pressure of the pressure resisting medium. This permits the movable plug to be moved depending upon the increase in the internal pressure of the pressure resisting medium so as to relieve the internal pressure and prevent the hollow member from being damaged due to the excessive internal pressure of the pressure resisting medium.

7 Claims, 8 Drawing Figures

METHOD OF DIE CASTING A METALLIC CAST PRODUCT HAVING A METALLIC HOLLOW MEMBER EMBEDDED THEREIN

BACKGROUND OF THE INVENTION

The present invention relates to a method of die casting a metallic cast product having a metallic hollow member such as a copper pipe, a brass pipe, a stainless steel pipe, an aluminum pipe and the like, which has a relatively thin wall thickness tending to be easily collapsed, embedded in the cast product without causing collapsing of the hollow member. Heretofore, a method of die casting a metallic cast product having a metallic hollow member embedded therein has been proposed. In the prior art method however, the hollow member tends to collapse during the die casting operation due to the high pressure of the molten metal which ranges in general from 200 kg/cm$^2$ to 1,000 kg/cm$^2$ for an aluminum molten metal for example. The hollow member has a relatively thin wall thickness resulting in insufficient strength to resist the pressure.

In order to avoid the above described deficiency, it has been proposed to insert a solid steel bar into the hollow member as a removable core member and, after the die casting operation, the solid steel bar is withdrawn from the hollow member so as to provide a completed cast product having a hollow member embedded therein. However, in such a method, no hollow member except a straight pipe member can be embedded in the cast product. Therefore, it has been impossible to provide a cast product having a hollow pipe member of any curved configuration embedded in the cast product by the die casting operation.

It has also been proposed to thicken the wall thickness of the hollow pipe member of any curved configuration or to make the hollow pipe member from a material having a greater hardness in order to afford a high buckling or collapsing resisting strength to the hollow pipe member for preventing the collapse of the hollow pipe member during the die casting operation. However, in such a measure, excessive wall thickness is required or an excessively high price is required for the hollow pipe member thereby rendering the above described measure to be impossible in practice.

Further, it has also been proposed to drastically reduce the die casting pressure of the molten metal in order to avoid the collapse of the hollow pipe member. However, in such a method, the filling of the cavity with molten metal is insufficient or the intimate adhesion of the hollow pipe member with the solidified metal is deteriorated thereby lowering the quality of the cast product such as, for example, deteriorating thermal conductivity of the cast product to the hollow pipe member embedded therein so that it can not be applied as a radiator or a heat exchanger requiring a high heat transmitting property.

SUMMARY OF THE INVENTION

The present invention aims at avoiding the above described difficulties in the prior art method of die casting a metallic cast product having a metallic hollow member embedded therein.

It is an object of the present invention to provide a novel and useful method of die casting a metallic cast product having a metallic hollow member embedded therein which avoids the above described disadvantages of the prior art methods.

Another object is to provide a method of the type described above wherein a pressure resisting medium is sealingly confined in the hollow member prior to the injection of the molten metal thereby positively preventing the hollow member from collapsing due to the high pressure of the molten metal injected into the die casting cavity around the hollow member to be embedded in the solidified metal.

A further object is to provide a method of the type described above wherein the pressure resisting medium is sealingly confined in the hollow member by a movable plug applied to an open end of the hollow member, and a fluid actuated plunger cooperates with the movable plug so as to apply thereto a constant resisting force against the internal pressure of the pressure resisting medium confined in the hollow member thereby insuring the pressure resisting medium to generate a resisting pressure of a constant value resisting against the die casting pressure of the molten metal injected into the die casting cavity so that rupture or damage to the hollow member due to excessively high internal pressure of the pressure resisting medium is positively avoided which might be caused during the die casting operation.

In accordance with a characteristic feature of the present invention, a method is provided for die casting a metallic cast product having embedded therein a metallic hollow member such as a copper pipe, a brass pipe, a stainless steel pipe, an aluminum pipe and the like which has a relatively thin wall thickness liable to be easily collapsed by the external pressure applied thereto, including locating the hollow member in position in the casting cavity formed between a pair of metallic die casting moulds tightly closed together, injecting the molten metal into the cavity around the hollow member, and sealingly confining a pressure resisting medium within the interior of the hollow member prior to injection of the molten metal into the cavity thereby positively insuring the hollow member from being collapsed by the pressure of the molten metal injected into the cavity and acting against the inner surface of the hollow member.

In the above method, the pressure resisting medium is sealingly enclosed within the interior of the hollow member by fixedly applying sealing plugs tightly to the open ends of the hollow member. The plugs are arrested by the moulds when the hollow member is located in position in the moulds prior to injection of the molten metal.

In order to make it possible to embed the hollow member in the cast product in accordance with the above described method of the die casting operation without causing any substantial deformation or damage to the hollow member, it is necessary to generate an internal pressure of the pressure resisting medium within the interior of the hollow member sufficient to resist against the injection pressure of the molten metal immediately after the injection of the molten metal into the cavity of the moulds.

If a liquid pressure resisting medium completely fills the interior of the hollow member without leaving any void therein, it is advantageous in that the response time of generating the initial internal pressure of the pressure resisting medium is very short, because the internal pressure is directly generated by the volumetric expansion of the liquid pressure resisting medium. On the other hand, however, the above described measure is disadvantageous in that the increase in the internal pressure occurring thereafter is substantially high thereby resulting in possible deformation or breakage in the hollow member at portions having relatively low strength.

In case a liquid pressure resisting medium is enclosed in the interior of the hollow member together with a gas, a certain time lag will take place in generating the initial internal pressure of the pressure resisting medium in comparison with the case in which the liquid pressure resisting medium completely fills the interior of the hollow member due to the existence of the compressible gas in the hollow member, so that the same would be collapsed or deformed because the internal pressure can not resist against the injection pressure of the molten metal thereby making it difficult to obtain a sound cast product having a thin-walled hollow member embedded therein. The present invention provides a method which positively avoids the above described difficulties.

In accordance with a further characteristics feature of the present invention, the method further includes sealingly confining the liquid pressure resisting medium in the interior of the hollow member by applying a movable plug to an open end thereof and locating a fluid actuated plunger so as to cooperate with the movable plug thereby permitting a constant force to be applied to the movable plug resisting against the internal pressure of the pressure resisting medium acting on the hollow member during the die casting operation so that the movable plug can be moved depending upon the increase in the internal pressure of the pressure resisting medium so as to relieve the internal pressure and prevent the hollow member from being damaged due to the excessively high internal pressure of the pressure resisting medium which might occur during the die casting operation.

The liquid pressure resisting medium is preferably of a liquid having a relatively low melting point and a relatively high boiling point. This makes it possible to maintain the internal pressure of the pressure resisting medium substantially constant at all times during the die casting operation.

In order to insure that the internal pressure of the pressure resisting medium be kept positively constant regardless of the increase in the internal pressure during the die casting operation so as to prevent the hollow member from being deformed or broken due to the excessively high internal pressure of the pressure resisting medium which might occur as the die casting operation proceeds, a pressure relieving member may be provided in the movable plug so as to relieve the excessively high internal pressure of the pressure resisting medium when the internal pressure increases and moves the movable plug a predetermined distance. Such pressure relieving member may be a groove formed longitudinally in the outer peripheral surface of the movable plug extending from the inner end thereof and terminating at a predetermined distance there from. When the movable plug is moved outwardly in response to the increase in the internal pressure of the pressure resisting medium beyond a predetermined value during the die casting operation and the outer end of the groove moves beyond the open end of the hollow member, the internal pressure is instantaneously relieved because of the leakage of the pressure resisting medium outwardly from the interior of the hollow member through the groove thereby lowering the internal pressure so that the movable plug is again pushed inwardly. The reacting force or cushioning force applied by the fluid actuated plunger against the movable plug thereby blocks the leakage of the pressure resisting medium and thus the value of the internal pressure given by the pressure resisting medium is maintained substantially constant.

In carrying out the above described method of the present invention, it is preferable to utilize a pore-free die cast process wherein the casting cavity is preliminarily filled with an active gas such as oxygen before the molten metal is injected into the cavity or a vacuum die cast process wherein air is exhausted preliminarily from the interior of the casting cavity before the molten metal is injected into the cavity. A hollow member having a smaller wall thickness can be embedded into the cast product without resulting in any collapsing or deformation thereof by virtue of the fact that inclusion of gas into the cast product can be made lesser by the above described pore-free die cast process or the vacuum die cast process in comparison with the ordinary die cast process thereby making it possible to lower the injection pressure of the molten metal in order to obtain a cast product of the practically satisfactory quality.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 1:
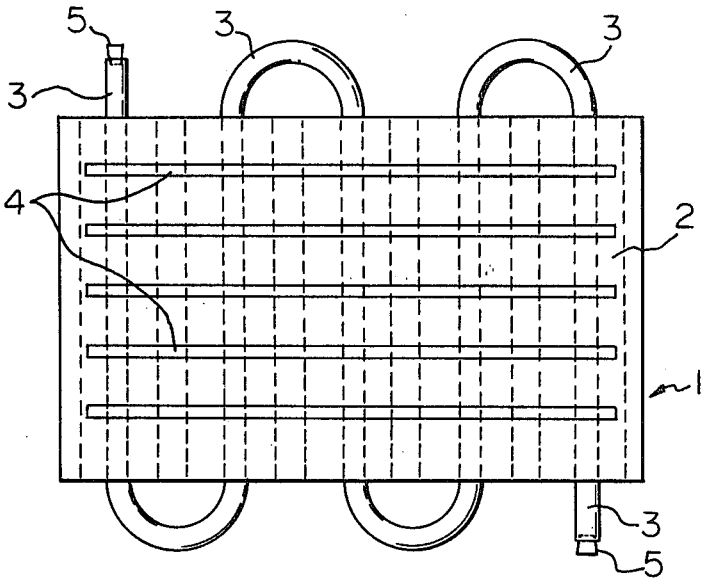
FIG. 1 is a front view showing an example of the cast product having a curved metallic hollow pipe member embedded therein produced by the method in accordance with the present invention.
Figure 2:
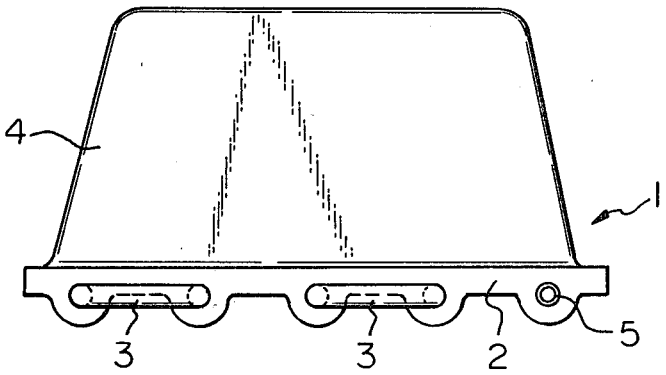
FIG. 2 is a side view of FIG. 1.

FIGS. 1 and 2 show an example of the cast product in the form of a heat exchanger 1 produced in accordance with the method of the present invention. The heat exchanger 1 includes a base 2 in one side of which a thin walled hollow pipe member 3 in the meanderingly curved configuration is embedded by the die casting operation, while a plurality of heat radiating fins 4 are formed in parallelly spaced relationship from each other at the other side of the base 2 also by the die casting operation.

Figure 3:
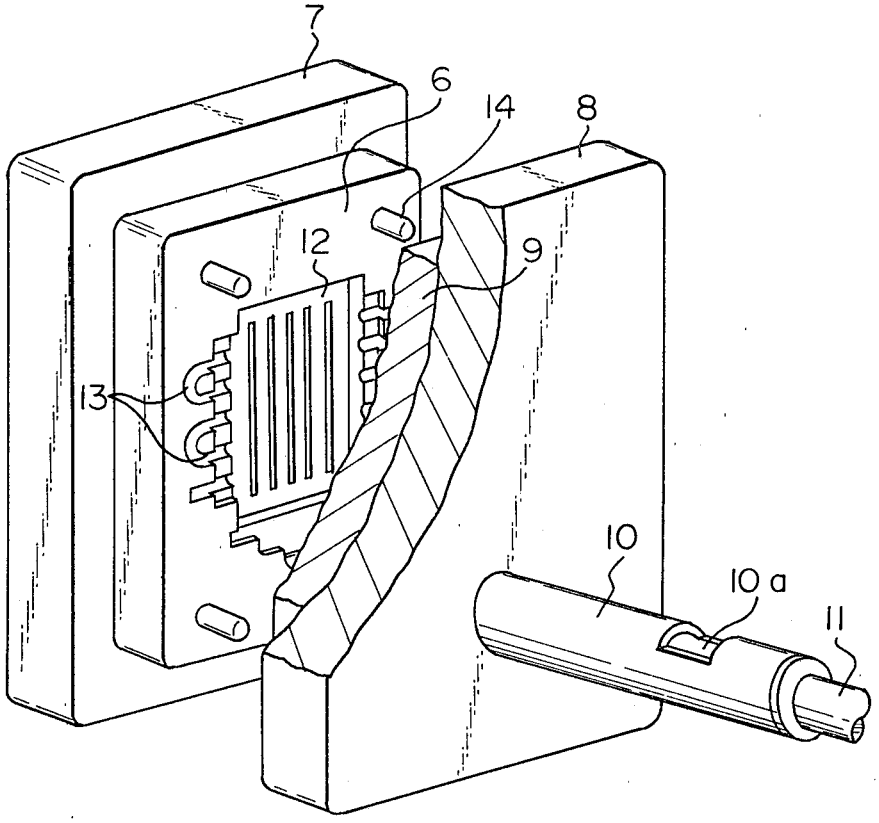
FIG. 3 is a perspective view showing the die casting metallic mould adapted to cast the cast product shown in FIG. 1.
Figure 4:
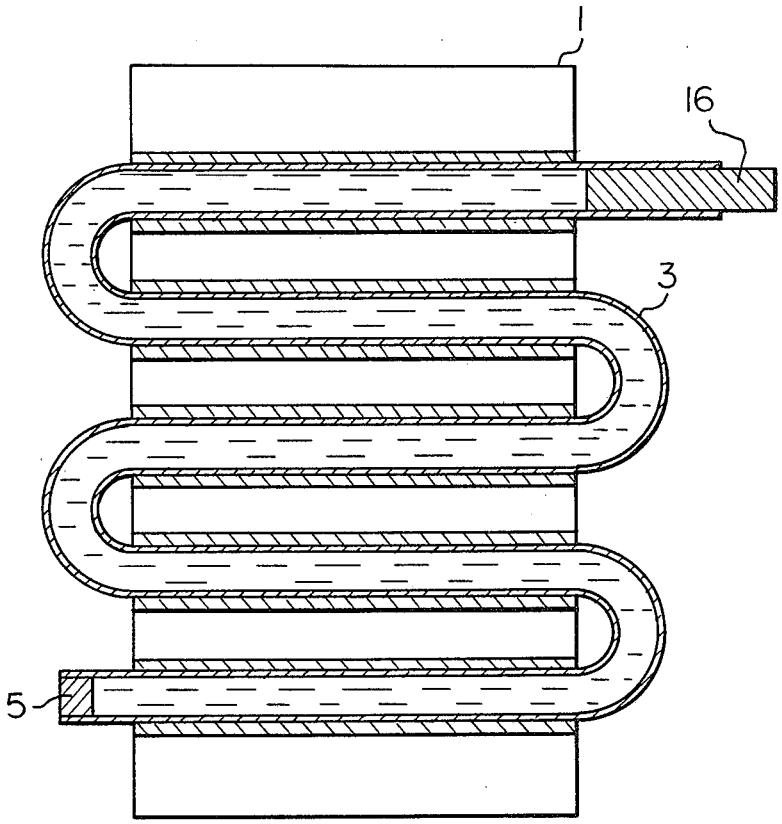
FIG. 4 is a cross-sectional view showing the curved metallic hollow pipe member embedded in the cast product shown in FIG. 1.

The cast product 1 is produced in accordance with the present invention by using a pair of metallic die casting moulds 6 and 9 each fixedly secured to a movable platen 7 and a stationary platen 8 of a die casting machine in the manner well known in the art as shown in FIG. 3. A molten metal injecting sleeve 10 having an injection plunger 11 slidably received therein is attached to the stationary platen 8 which communicates with the mould 9 so that, when a predetermined amount of the molten metal is injected into the cavity 12 formed between the pair of moulds 6, 9 held tightly closed together through the sleeve 10 by urging the plunger 11 toward the mould 9 after the molten metal is supplied into the sleeve 10 through the pouring gate 10*a* thereof, a cast product is produced having the configuration conforming with the shape of the cavity 12 as is well known in the art.

The metallic hollow member to be embedded in the cast product in accordance with the present invention is shown as a meanderingly curved thin walled pipe member 3 in FIG. 1, for example. However, the hollow member may be of any bent shape having, if desired, a number of fins formed on the outer surface thereof insofar as the hollow member is provided with at least an open end permitting the interior of the hollow member to communicate with the exterior thereof.

In accordance with the present invention, a pressure resisting medium is filled in the interior of the pipe member 3 and a pair of sealing plugs 5 are tightly applied to the respective open ends of the pipe member 3. The pressure resisting medium may be water or alcohol which is rendered to vaporize at the temperature of the molten metal to be injected into the cavity 12, or it may be a substance such as sodium bicarbonate dissolved in water the solute of which is rendered to be decomposed to generate gas at the temperature of the molten metal, or it may be a substance such as silicone oil which raises the internal pressure of the pressure resisting medium enclosed in the interior of the pipe member 3 due to the volumetric expansion thereof at the temperature of the pressure resisting medium. The plugs 5 are preferably made of an elastic material such as rubber which will be deformed when the internal pressure is excessively raised thereby avoiding the danger of breakage or rupture of the pipe member 3. The volume of the pressure resisting medium to be filled in the interior of the pipe member 3 is so selected such that it can generate an internal pressure sufficient to resist against the injection pressure of the molten metal produces by the operation of the plunger 11.

In the operation, the metallic thin walled pipe member 3 filled with the appropriate quantity of the pressure resisting medium therein and tightly sealed by use of the plugs 5 is fitted in position in the engaging grooves 13 formed in the cavity 12 (the grooves 13 being shown in FIG. 3), and the moulds 6, 9 are closed tightly together wherein guide rods 14 fixedly secured to the mould 6 are snugly fitted in guide holes 15 (FIG. 6) in the mould 9 so as to exactly position the mould 6 with respect to the mould 9.

The placement of the pipe member 3 in position in the moulds 6, 9 may be effected alternatively by any suitable positioning member provided in the stationary mould 9 depending upon the design of the moulds 6, 9. In this case, the plugs 5 are preferably arrested by inner walls formed in the cavity 12 in either or both of the moulds 6, 9 so that the plugs 5 are positively prevented from being removed unintentionally from the pipe member 3 due to the internal pressure of the pressure resisting medium in the pipe member 3 during the die casting operation. The die casting operation may be carried out in the conventional manner by using an upright or horizontal type die casting machine. The injection pressure of the molten metal is in general selected to be 200–1,000 kg/cm$^2$ in the case of aluminum die casting operation.

The molten metal injected into the cavity 12 is filled therein around the pipe member 3, and a part of the heat given by the hot molten metal is transmitted to the pressure resisting medium sealed in the interior of the pipe member 3 so that it is volumetrically expanded or it is partially gasified or the solute in the pressure resisting medium is decomposed thereby increasing the internal pressure of the medium. The thus increased internal pressure of the pressure resisting medium in the pipe member 3 serves to positively prevent the pipe member 3 from being collapsed due to the injection pressure of the molten metal.

As described above, a hollow member can be embedded in the cast product in the die casting operation without causing any deformation or collapsing thereof even though the hollow member is a thin walled member and even though it has any curved configuration. After the molten metal is solidified and cooled to an appropriate temperature, the plugs 5 are removed and the pressure resisting medium is removed from the hollow member so as to be used in the next die casting operation. The method of the present invention is most suited for use in producing a cast product having a hollow member embedded therein such as a heat exchanging mechanism in a boiler, a solar collector, a cylinder head, a cylinder block and the like.

EXAMPLE 1

A heat exchanger as shown in FIGS. 1 and 2 was produced in accordance with the method of the present invention, wherein a copper pipe in the curved form as shown and having the outer diameter of 12 mm and filled with water in the interior of the pipe as the pressure resisting medium with rubber plugs being tightly applied to the open ends was embedded in the cast product. The wall thickness of the copper pipe was selected to be 0.8 mm, 1.0 mm, 1.2 mm and 1.4 mm, respectively.

The pipe thus prepared was fitted in position in the cavity of the moulds so that the plugs were arrested by the inner walls of the cavity. After closing the moulds, a quantity of about 2 kg of the molten metal of die casting alloy ADC 1 held at the temperature of 650° C. was injected into the cavity by means of the plunger after the molten metal was supplied into the sleeve by using a ladle. The injection pressure of the molten metal was selected to be 200, 300, 500 and 600 kg/cm$^2$, respectively.

The results are shown in the following Table 1. No collapsing of the pipe occurred in any of the pipes, and the intimate contact of the pipe with the cast metal was insured in all cases.

EXAMPLE 2

The tests were carried out in the similar manner as described in Example 1 except that an aluminum pipe having the outer diameter of 12 mm and the wall thickness of 1.2 and 1.6 mm was used in place of the copper pipe.

After the moulds were closed, 2 kg of the molten metal of the die casting alloy ADC 1 held at the temperature of 650° C. was injected into the cavity in like manner as in Example 1.

The results are also shown in the following Table 1. No collapsing of the aluminum pipe occurred in any of the pipes and the tight contact of the pipe with the cast metal was insured.

TABLE 1

| | Thin Wall Hollow Member Used | |
|---|---|---|
| | Copper Pipe | Aluminum Pipe |
| Outer Dia. (mm) | 12 | 12 |
| Wall Thickness (mm) | 0.8, 1.0, 1.2, 1.4 | 1.2, 1.6 |
| Pressure Resisting Medium | Water | Silicone Oil |
| Cast Metal | ADC 1 | ADC 1 |
| Casting Temperature (°C.) | 650 | 650 |
| Injection Pressure ($kg/cm^2$) | 200, 300, 500, 600 | 200, 300, 500, 600 |
| Collapsing of Pipe | No | No |

FIGS. 4–8 show another embodiment of the method of the present invention, wherein plug 16 sealingly applied to the open ends of the thin walled pipe member 3 is rendered to be movable in response to the increase in the internal pressure of the pressure resisting medium enclosed in the pipe member 3 during the die casting operation, against which movable plug 16 a fluid actuated plunger 17 of a damper mechanism is opposed so as to provide cushioning effect to the movable plunger 16.

In this case, a pressure resisting liquid medium having a low melting point and a high boiling point completely fills the interior of the pipe member 3 and is sealed against the exterior of the pipe member 3 by the stationary plug 5 and the movable plug 16 without leaving any void therein. To this end, the movable plug 16 is preferably of a solid cylinder having a circular cross-section and made of hard rubber in the view point of economy, or made of polyurethane insuring a great durability or polyfluoroethylene insuring a high working accuracy, and the diameter of the plug 16 is selected to be equal to or slightly larger than the inner diameter of the pipe member 3 so that sufficient pressure resisting strength against the internal pressure of the pressure resisting medium is insured when the plug 16 is applied to the pipe member 3.

The effective length D of the plug 16 is selected to be the sum of a length A corresponding to the volumetric thermal expansion of the pressure resisting medium, a minimum distance B required for permitting the pressure resisting medium to be sealingly maintained in the interior of the pipe member 3 at a predetermined internal pressure and a distance C required for preliminarily applying a preparatory internal pressure to the pressure resisting medium. The plug 16 is further formed with an additional portion 16*a* which extends outwardly from the open end of the pipe member 3 when the plug 16 is sealingly applied to the pipe member 3.

Figure 6:
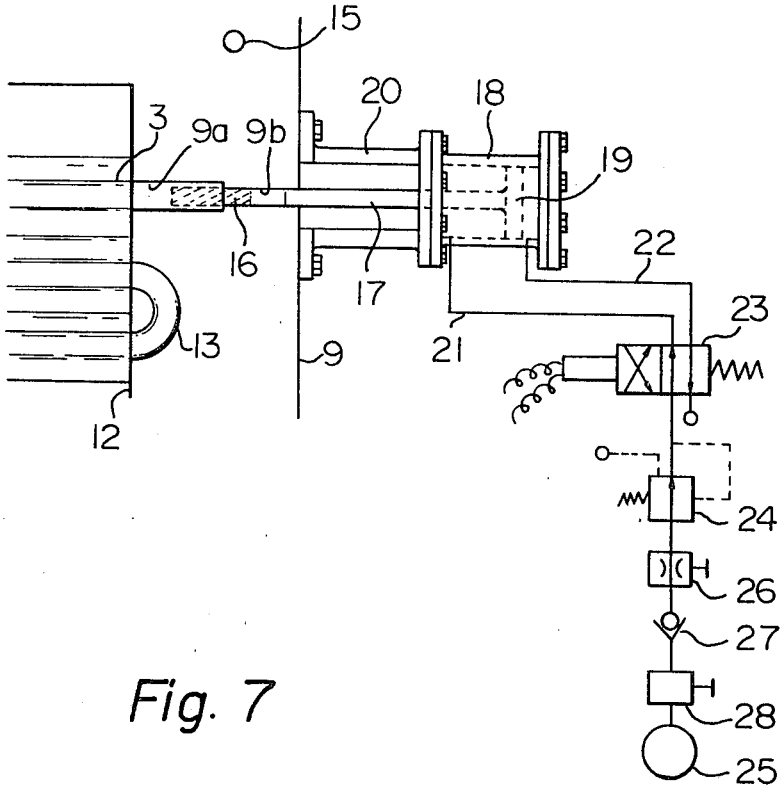
FIG. 6 is a view showing the damper mechanism attached to the stationary mould and actuated by a fluid actuated system constructed in accordance with the present invention, the damper mechanism being shown in its released position.
Figure 7:
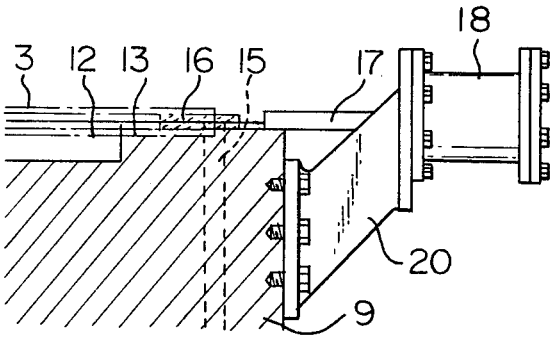
FIG. 7 is a side view partly in cross-section of FIG. 6.

The damper mechanism for applying a fluid actuated force to the plunger 17 in order to provide the cushioning effect to the movable plug 16 described above includes a fluid actuated cylinder device 18 having a piston 19 slidably received therein, the plunger 17 being integral with the piston rod of the piston 19. The cylinder device 18 is secured to a supporting bracket 20 which is in turn fixedly secured to one side surface of the stationary mould 9. Alternatively, the cylinder device 18 may be attached to the movable mould 6. The cylinder device 18 is so positioned that the axis of the plunger 17 is in alignment with the axis of the open end of the pipe member 3 which is snugly received in the half circular recess 9*a* formed in the mould 9 and into which the movable plug 16 is compressively inserted so as to sealingly seal the pressure resisting medium within the interior of the pipe member 3 so that a half circular recess 9*b* coaxial with the recess 9*a* and snugly receiving therein the portion 16*a* of the movable plug 16 is adapted to receive therein the portion of the tip portion of the plunger 17 as shown in FIG. 6 with a gap provided between the plug 16 and the plunger 17 as described below.

Figure 8:
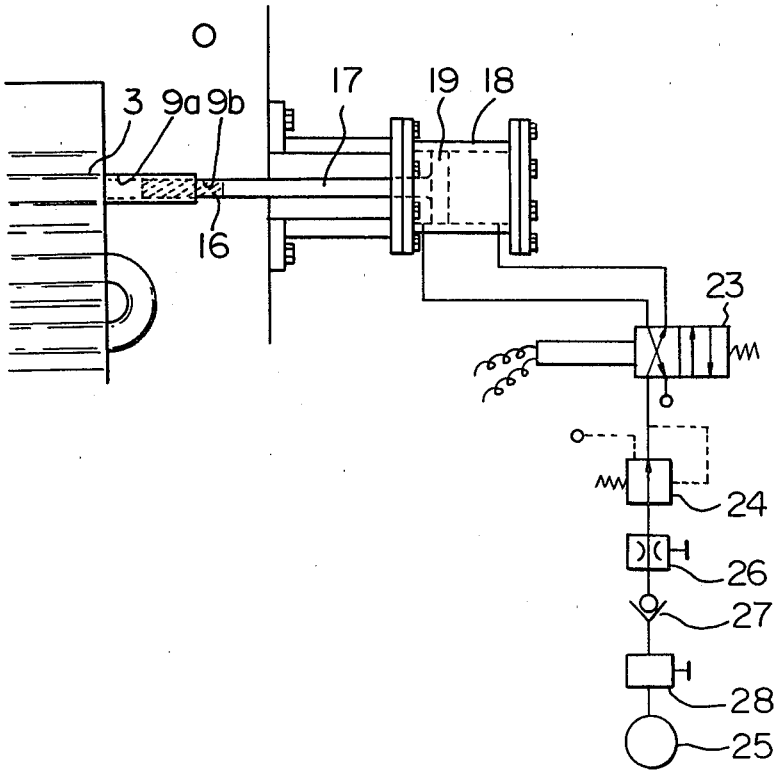
FIG. 8 is a view similar to FIG. 6 but showing the damper mechanism in its activated position.

The respective pressure chambers located at opposite sides of the piston 19 in the cylinder device 18 are each connected to one end of the conduits 21, 22, respectively, the other end of which are connected to a solenoid actuated switching valve 23 which is in turn connected to a pressure regulating valve 24 and to the atmosphere. The valve 23 is connected to a fluid pressure generating device 25 such as a compressor through a throttle valve 26 (a speed regulator), a check valve 27 and a stop valve 28 as shown in FIG. 6. Thus, upon operating the compressor 25 with the stop valve 28 held opened and the throttle valve 26 and the pressure regulating valve 24 adjusted appropriately, the piston 19 and, hence, the plunger 17 of the cylinder device 18 is moved to the retracted position as shown in FIG. 6 or moved to the forwardly urged operative position as shown in FIG. 8 at which the plunger 17 abuts against the movable plug 16 and urges the same inwardly of the pipe member 3 depending upon the switched position of the solenoid actuated switching valve 23. When the movable mould 6 is moved in contact with the mould 9, the open end of the pipe member 3 received in the half circular recess 9*a* and the projecting portion 16*a* of the plug 16 received in the half circular recess 9*b* of the mould 9 are snugly received in the respective complementary half circular recesses formed in the movable mould 6, respectively.

In operation of the above described device, the interior of the pipe member 3 is completely filled with the pressure resisting fluid medium with the stationary plug 5 and the movable plug 16 sealingly applied to the respective open ends of the pipe member 3, and it is placed in position in the recess 13 in the cavity 12 with the open end of the pipe member 3 receiving the plug 16 and the projecting portion 16*a* of the plug 16 being received snugly in the respective recesses 9*a* and 9*b*. Then, the moulds 6, 9 are tightly closed together. At this time, the solenoid actuated switching valve 23 is held in the inoperable position as shown in FIG. 6 in which the plunger 17 is held retracted so as to be spaced apart from the plug 16 with a certain gap provided between the plug 16 and the plunger 17.

Thereafter, the solenoid actuated switching valve 23 is switched to the position shown in FIG. 8 so as to urge the plug 16 inwardly of the pipe member 3 thereby generating a preparatory internal pressure of the pressure resisting medium in the pipe member 3. Then, the molten metal is injected into the cavity 12 by operating the plunger 11. As the molten metal is introduced into the cavity 12, a peak casting pressure is instantaneously generated and, at the same time, the internal pressure of the pressure resisting medium in the pipe member 3 increases by virtue of the thermal expansion thereof resulted from the heat transmitted from the molten metal to the pressure resisting medium as well as the increase in the internal strains in the pipe member 3 per se against the instantaneous load applied thereto, thereby permitting the pipe member 3 to be positively prevented from being collapsed.

As the casting pressure comes to the terminal period in which only a static fluid pressure exists (a few seconds), the temperature of the pressure resisting medium in the pipe member 3 is still increasing and the internal pressure is further increased thus preventing the pipe member 3 from being collapsed. As the injected molten metal approaches the half solidified state, the rise in temperature still proceeds while the pressure of the molten metal is in the terminal state, thereby further raising the internal pressure of the pressure resisting medium in the pipe member 3. When the internal pressure exceeds the predetermined pressure as set in the damper mechanism, the movable plug 16 is urged outwardly against the action of the plunger 17 so as to move the same together with the plug 16. The amount of the movement of the plug 16 and the plunger 17 is, however, very small because it is caused only by thermal expansion of the liquid pressure resisting medium.

Finally, solidification of the injected molten metal commences so as to cause the shrinkage of the metal, while the rate of the rise in the temperature of the pressure resisting medium is rendered to be slow, so that the cylinder device 18 absorbs or compensates for the residual thermal expansion of the pressure resisting medium and the contacting pressure of the solidifying metal. The contracting pressure of the solidifying metal is under a condition under which the contracting pressure is easily absorbed or compensated for, because the pipe member 3 is still kept at the high temperature.

As the solidification of the molten metal terminates, the damper mechanism is released or the solenoid actuated switching valve 23 is switched to inoperative position of the cylinder device 18, so that the plunger 17 is retracted so as to resume the position shown in FIG. 6, thereby rendering the pressure of the pressure resisting medium to consist only of the pressure caused by the friction of the movable plug 16. Then, the moulds 6, 9 are opened and the cast product is knocked out from the cavity 12. After the cast product is cooled to an appropriate temperature, the plugs 5 and 16 are removed from the pipe member 3 and the pressure resisting medium therein is collected for the next use. By the above described method, a cast product having a thin walled hollow member embedded therein is obtained in which no deformation or collapsing of the hollow member takes place.

Figure 5:
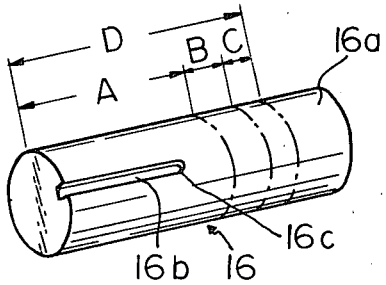
FIG. 5 is a perspective view showing the movable plug of the present invention.

In accordance with a further characteristic feature of the present invention, a member may be provided which positively insures the internal pressure of the pressure resisting medium to be kept substantially constant steadily throughout the die casting operation. The above described member includes a longitudinal groove **16*b* formed in the outer surface of the movable plug 16 extending from the innermost end thereof to an appropriate position as shown in FIG. 5. The groove 16*b* serves to leak the pressure resisting medium out of the pipe member 3 through the groove 16*b* when the internal pressure of the pressure resisting medium is raised so that the plug 16 is urged outwardly to the position in which the blind end 16*c* communicates with the exterior of the pipe member 3 thereby lowering the internal pressure. When the internal pressure is lowered to a value at which the plug 16 is again moved back into the pipe member 3 by the action of the plunger 17 of the predetermined fluid force so as to shut off the communication of the groove 16*b* with the exterior of the pipe member 3**, the internal pressure is again raised. Thus, the internal pressure of the pressure resisting medium is kept substantially constant.

The groove **16*b* may be alternatively of a longitudinal hole drilled in the plug 16 and the fluid end is connected to a radial hole so that the pressure resisting medium can be leaked out when the plug 16** is moved outwardly a certain distance in like manner as described above.

In accordance with the above described method of the present invention, the following effectiveness is achieved:

(1) Since a liquid is used as the pressure resisting medium for the pipe member, any pipe member having various curved configuration can be embedded in a cast product produced in accordance with the method of the present invention.

(2) The amount of movement of the plunger of the damper mechanism is very small and the response time for moving the movable plug in response to the increase in the internal pressure in the pipe member during the die casting operation is very short, because they are resulted only from the volumetric expansion. The rate of contraction is very small by virtue of the fact it is effected only by the liquid in comparison with the case in which a gaseous medium is used, thereby making it possible to avoid the scattering of the medium or explosive rupture of the pipe member.

(3) The damper mechanism is very simple in construction and it may be easily incorporated in the sequential control circuit of the die casting machine. That is, a solenoid actuated valve is operated once in one cycle of a die casting operation at a predetermined time in the cycle.

(4) An initial preliminary internal pressure may be given to the pressure resisting medium sealed in the pipe member resisting against the injection pressure of the molten metal during the die casting operation, and, in case the internal pressure of the pressure resisting medium exceeds the present pressure in the damper mechanism, the movable plug is moved so as to leak the medium out of the pipe member. This relieves the internal pressure so that the internal pressure of the pressure resisting medium can be maintained at a substantially constant pressure. This insures the safe operation of the die casting machine and a high quality of the pipe member embedded in the cast product. Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of die casting a metallic cast product having a hollow metallic member embedded therein utilizing a damping mechanism comprising:

sealingly enclosing a pressure resisting fluid medium within the interior of said hollow member;

placing said hollow member in position in a cavity formed between a pair of metallic die casting moulds;

injecting molten metal into the cavity;

generating internal pressure within the hollow member by thermal expansion of the fluid medium due to heat transmitted by the molten metal wherein said step of sealingly enclosing said pressure resisting fluid medium comprises:

sealingly mounting a slidable sealing plug to at least one open end of said hollow member so as to seal said pressure resisting fluid medium within the interior of said hollow member; and relieving the internal pressure of the hollow member by allowing the sealing plug to slide against a resisting force of said damping mechanism when the internal pressure rises excessively.

2. A method of die casting a metallic cast product having a hollow metallic member embedded therein comprising:

enclosing a pressure resisting medium within the interior of said hollow member;

placing said hollow member in position in a cavity formed between a pair of metallic die casting moulds;

sealing a movable sealing plug to at least one open end of said hollow member to seal said pressure resisting medium within the interior of said hollow member;

injecting molten metal into the cavity; and abutting a plunger of a fluid actuated damper mechanism against said movable plug so as to resist movement of said movable plug during injection of said molten metal into said cavity.

3. The method according to claim 2, said damper mechanism further comprising a fluid actuated cylinder device having a slidable piston integrally connected to said plunger, which further comprises:

applying fluid pressure to said piston prior to injection of said molten metal such that a preliminary internal pressure is generated in said hollow member; and resisting movement of said plunger during injection of said molten metal.

4. The method according to claim 3, said damper mechanism further comprising a pressure regulating valve, which further comprises regulating the pressure in the damper mechanism by said pressure regulating valve.

5. The method according to claim 2, said movable plug further comprising communicating means formed therein, which comprises:

sliding said movable plug a predetermined distance outwardly of said hollow member when the pressure in the interior of the hollow member exceeds the pressure of the damper mechanism; and leaking pressure resisting medium from the interior of said hollow member to the exterior by said communicating means when said plug is moved outward.

6. The method according to claim 5, wherein said communicating means comprises a longitudinal groove formed in the peripheral surface of said movable plug, said groove extending from the innermost end of said plug and terminating at a predetermined position such that the interior of said hollow member communicates with the exterior through said groove.

7. The method according to claim 5, wherein said communicating means comprises a blind hole opening at the innermost end of said movable plug and extending longitudinally therein to a predetermined position at which it communicates with a radial hole opening at the peripheral surface of said movable plug such that the interior of said hollow member communicates with the exterior through said blind and radial holes.

* * * * *